US005270900A

United States Patent [19]

Alden et al.

[11] Patent Number: 5,270,900

[45] Date of Patent: Dec. 14, 1993

[54] SOLENOID RESPONSE DETECTOR

[75] Inventors: Eric D. Alden, Portage; Mark D. Thompson, Niles, both of Mich.; Ivan L. Harneck, South Bend, Ind.

[73] Assignee: Allied-Signal Inc., Morristown, N.J.

[21] Appl. No.: 819,718

[22] Filed: Jan. 13, 1992

Related U.S. Application Data

[63] Continuation-in-part of Ser. No. 360,174, Jun. 1, 1989, abandoned.

[51] Int. Cl.[5] ..... H01H 47/22

[52] U.S. Cl. ..... 361/153; 361/159; 361/171; 361/186; 361/195

[58] Field of Search ..... 361/139, 143, 149, 152, 361/153, 159, 160, 170, 171, 186, 189, 190, 195

[56] References Cited

U.S. PATENT DOCUMENTS

| | | | |
|---|---|---|---|
| 4,490,771 | 12/1984 | Huber et al. | 361/154 |
| 4,631,627 | 12/1986 | Morgan | 361/153 |
| 4,810,952 | 3/1989 | Cohen | 361/160 |
| 4,845,420 | 7/1989 | Oshizawa et al. | 361/153 |

*Primary Examiner*—Jeffrey A. Gaffin
*Attorney, Agent, or Firm*—Leo H. McCormick, Jr.; Larry J. Palguta; Robert A. Walsh

[57] ABSTRACT

An apparatus for energizing the coil of, and detecting the resultant armature actuation in, a solenoid of the type having a movable armature reciprocable along an axis between first and second positions, a spring bias normally biasing the armature toward the first position, and an actuating coil for inducing a force on the armature tending to move the armature from the first position toward the second position in response to current flow in the actuating coil. A voltage is first provided to the solenoid coil and thereafter, a resulting current flow is differentiated and a zero crossing comparator is utilized to determine when the differentiated current is zero and, therefor, the time at which the sensed current flow reaches a maximum (dv/dt=0). The time at which the armature began to move in response to the resulting coil current may be inferred and the voltage to the solenoid coil interrupted a Predetermined time after the time at which the armature began to move.

2 Claims, 2 Drawing Sheets

SOLENOID RESPONSE DETECTOR

CROSS-REFERENCE TO RELATED APPLICATIONS

This application is a continuation-in-part of our copending application Ser. No. 07/360,174 filed Jun. 1, 1989 now abandoned.

SUMMARY OF THE INVENTION

The present invention relates generally to an arrangement for detecting actuation of a solenoid and more particularly to such an arrangement for sensing solenoid armature movement in a solenoid actuated valve.

Such solenoids are typically of the type having an actuating coil, a movable armature reciprocable along an axis between first and second positions corresponding to valve-closed and valve-open positions, respectively. A spring or other means normally biases the armature toward the first position, with the actuating coil inducing a force onto the armature tending to move the armature from the first position toward the second position in response to current flow in the actuating coil.

An illustrative preferred environment of the present invention is in the control of electrohydraulic actuators for dosers of the type disclosed in U.S. Pat. No. 4,256,017 to Eastman. Briefly, when a measured quantity or "dose" of hydraulic fluid is injected into or exhausted from a control chamber of a differential area piston, motion or output occurs in a step movement commensurate with the size of the input dose. The dose may be controlled by controlling the time duration of an enabling pulse to a solenoid actuated valve. The smallest discrete movements of the piston and, therefor, also the minimal or "quantum" dose occurs for the shortest effective actuation interval of the actuator.

For precision positioning of a doser actuator, it is highly desirable to accurately deliver pulses which are of only slightly greater duration than the minimum threshold pulse for a given solenoid valve. Such a minimal duration pulse will be of sufficient duration to ensure that the valve moves from the normally closed position fully to the open position under all expected operating conditions while a pulse of lesser duration may not be sufficient to ensure full opening of the valve.

Doser control circuits are well known. For example, U.S. Pat. No. 4,366,743 discloses a circuit which supplies a pulse of slightly shorter duration than the anticipated threshold pulse and then incrementally increases the pulse width each time the controlled senses that the solenoid threshold has not been exceeded. Since several increments are usually required, this approach is inherently slow and has significant time lag problems. The use of Proportional incrementation calculations in systems similar to the patented device have increased the costs of such systems and only partially alleviated the time lag problem.

Among the several objects of the present invention may be noted the provision of a simple and inexpensive solenoid actuation detector; the provision of a detector in accordance with the previous object which is easily retrofitted to existing solenoid control loops; the provision of a circuit for providing a pulse to a solenoid controlled, in part, by detection of the actuation of that solenoid; the elimination of mechanical switches, scheduling circuits, or pulse incrementation logic circuitry typical of Prior solenoid movement sensors; the provision of a solenoid actuation detector having very rapid response characteristics and reduced sensitivity to loading effects; and the provision of a simplistic yet effective solenoid response detector suitable for doser threshold detection applications. These as well as other objects and advantageous features of the present invention will be in part apparent and in part pointed out hereinafter.

In general, an apparatus is disclosed for energizing a solenoid coil and of determining completion of the motion of an armature of the solenoid includes providing a voltage to the solenoid coil and sensing the resulting current flow in the solenoid coil. The sensed current flow may be differentiated and zero crossing of the differentiated current used to determine the time at which the sensed current flow reaches a maximum and one-half cycle of the motion of the armature is completed. By appropriate biasing, the zero crossing may be made to-occur earlier inferring the time at which the armature began to move in response to the resulting coil current. The voltage to the solenoid coil is interrupted a predetermined minimal time after the time at which the armature began to move.

Also in general and in one form of the invention, a pulse width control circuit for a solenoid includes an arrangement for initiating current flow in the solenoid actuating coil along with circuitry for determining the arrival time at which the armature arrives a the second or valve open position. This arrival time may then be used to estimate the departure time of initial armature movement away from the first position. Current flow in the actuating coil is then terminated a predetermined time after initial armature movement away from the first position. The circuitry for determining arrival time may includes a small resistor for sensing actuating coil current flow, a resistance-capacitance circuit for differentiating the sensed actuating coil current flow, and a comparator for identifying the time at which the differentiated current is at a prescribed value. Utilizing the arrival time to estimate the departure time may be accomplished by a variable direct current biasing circuit coupled to the comparator for changing the Prescribed value thereby shifting the time at which the differentiated current is identified as being at a prescribed value. The circuitry for terminating actuating coil current flow includes: a source of timing pulses; a decrementable counter; control circuitry for loading a number indicative of the predetermined time into the counter and for initiating counter decrementation at the estimated departure time; and a counter responsive circuit which is operable upon the count in the counter reaching zero for interrupting the current flow in the actuating coil. There may be a plurality of counter responsive circuits with the pulse width control circuit being shared by a like plurality of solenoids. The counter responsive circuit and the arrangement for initiating current flow may share at least one common circuit element such as a gate controlled switch or similar on/off switching device.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 3:
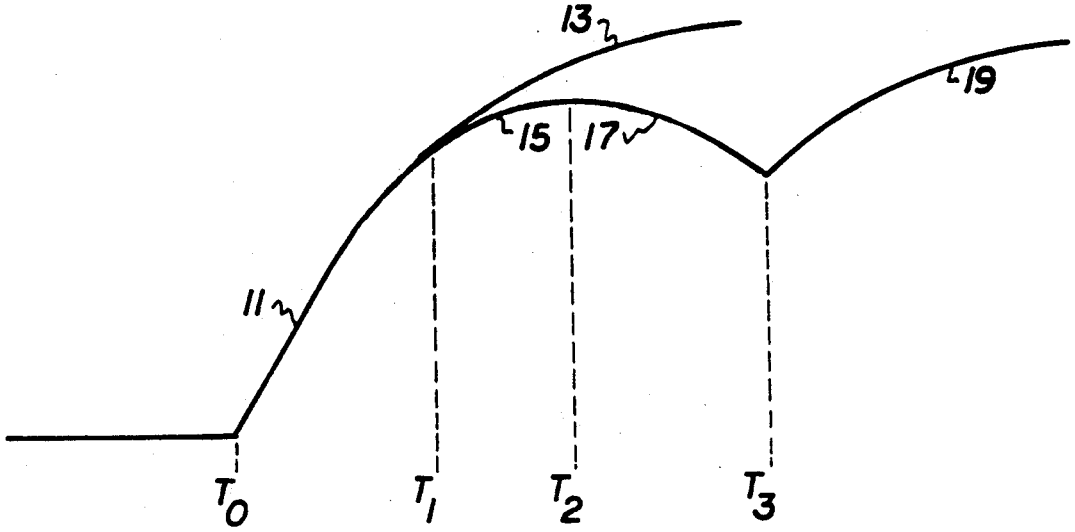
FIG. 3 is an enlarged view of a typical solenoid current waveform.
Figure 5:
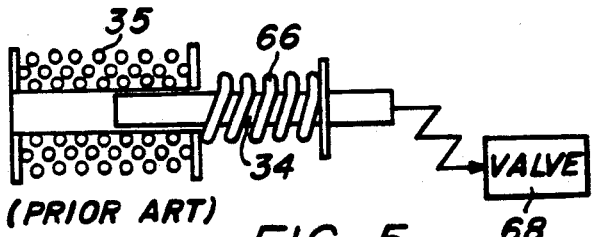
FIG. 5 is a schematic representation of an illustrative valve and spring-biased solenoid partially in cross-section.

The current flow depicted in FIG. 3 is typical for a coil 35 of the type solenoid illustrated in FIG. 5. The solenoid has a moveable armature 34 which is reciprocable, horizontally as depicted, along an axis between first and second positions corresponding to closed and open positions of a valve 68. Coil spring 66 function as a biasing means for urging the armature 34 toward the first or valve-closed position and an actuating coil 35 is responsive to current flow for inducing a force on the armature to overcome the biasing means to move the armature from the first position toward the second or valve-open position. When a step voltage is applied at time T0 to the coil 35 of the solenoid, the current in the coil begins to increase along the familiar exponentially increasing waveform 11 of FIG. 3 with time constant L/R. If the solenoid armature 34 fails to move, the time constant is unchanged and the current continues to increase to a steady state value along this same exponential curve, i.e., along the curve portion 13. However, if the solenoid armature begins to move at time T1 in response to the current in the coil, the inductance of the coil is changed to a new not necessarily constant value L' by this armature movement and the current deviates to follow a new generally exponentially increasing curve 15 with the new time constant L'/R. When the armature comes to rest at T2 in its new position corresponding to an open position for valve 68, the inductance reverts to a constant value near the original value L, but there is a temporary back EMF generated in the coil which opposes the applied voltage and actually results in a temporary decrease in coil current as along the curve portion 17. Thereafter, at time T3, the current again increases exponentially with the original L/R time constant along curve segment 19. If the applied voltage is a pulse rather than a step of voltage, a somewhat similar decay of the coil current occurs upon the termination of the applied voltage.

Figure 1:
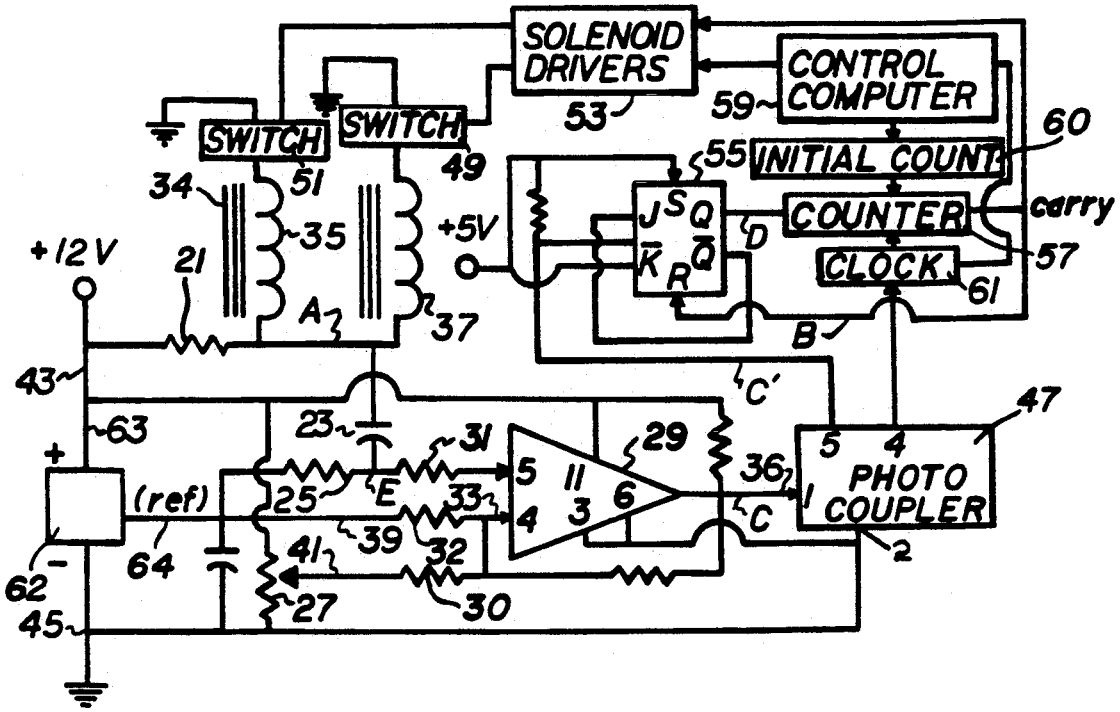
FIG. 1 is a schematic diagram of an electrical circuit suitable for the practice of the present invention.
Figure 2:
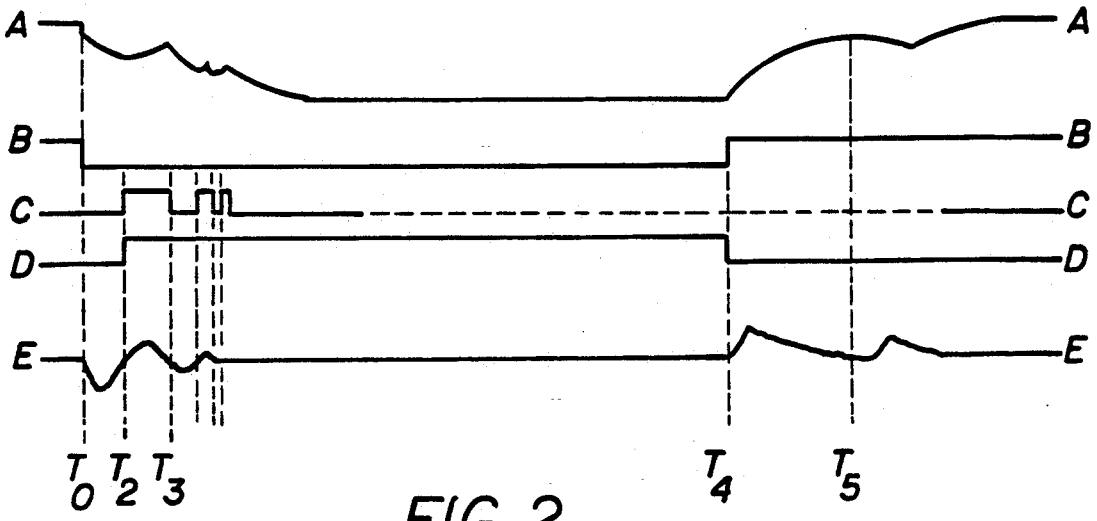
FIG. 2 is a collection of voltage or current waveforms on a common time scale at various points within the circuit of FIG. 1.

Waveform A in FIG. 2 is a waveform of the voltage across a small current monitoring resistor 21 in the circuit of FIG. 1 and, while it appears inverted when compared to FIG. 3, it accurately depicts the current flow in one of the solenoid coils 35 or 37. Comparing FIGS. 2 and 3, the time interval between T0 and T2 represents the time required for the solenoid to operate after the voltage is applied, i.e., the opening delay. In the event the armature bounces or rebounds from its valve-open or actuated position as is frequently the case, it is repeatedly driven back toward that open position by the magnetic field generated by coil current and there is a series of repetitions of the sequence of events occurring after T3 in FIG. 3. A number of such rebounds or bounces are seen just subsequent to T3 in waveform A of FIG. 2 before the coil current reaches its steady state value. The coil voltage pulse terminates at T4 and the armature returns to its initial position at T5. Coil current decay follows the same sequence of events as described in conjunction with FIG. 3. Armature bounce and the resulting oscillations may occur upon deenergization, or depending on armature damping, the restorative force and other design parameters, no oscillation may appear. The solenoid closing delay for the particular illustrative solenoid is greater than the opening delay and no oscillations on closing are depicted in FIG. 2.

In the circuit of FIG. 1, a small resistance 21, such as one ohm, is inserted in series with the supply and return solenoids. The current in the operating solenoid may then be monitored by sensing the voltage drop (shown in FIG. 2, waveform A) across this resistor 21. In this particular embodiment, the solenoids 35 and 37 are never energized at the same time, thus only one common resistor 21 is needed.

Figure 4:
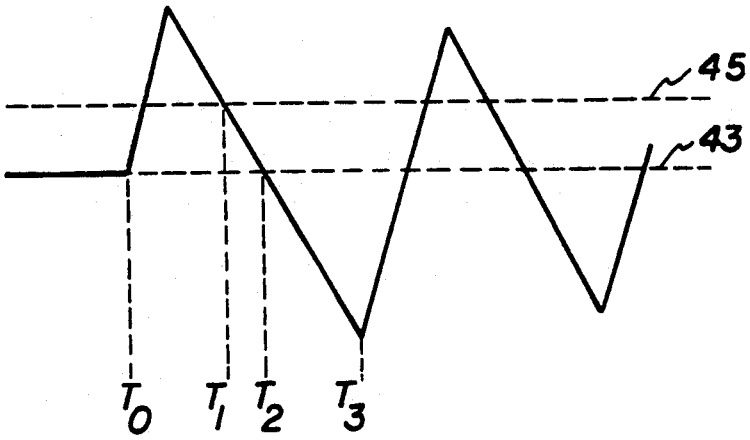
FIG. 4 is a waveform illustrating the effect of variation of the bias in the circuit of FIG. 1.

To approximate the point at which solenoid armature movement begins, the point at which the first oscillation occurs is determined by capacitor 23 and resistor 25 which differentiate the voltage across resistor 21 (FIG. 2, waveform A). This differentiated voltage is depicted as waveform E in FIG. 2 where each zero crossing or time when $dv/dt=0$ corresponds to a peak (maximum or minimum) of the solenoid coil current. Waveform E is illustrated in somewhat exaggerated form in FIG. 4. The first such zero crossing occurs at the time T2 when the armature reaches its full stroke, but may be used employing the variable bias adjustment resistor or potentiometer 27 to estimate the time T1 at which the armature begins to move. When potentiometer 27 is set so that the voltage on line 41 is the same as on line 39, comparator 29 is unbiased and zero crossing occurs at T2 in FIG. 4. The concept of the present invention is more easily explained in terms of "zero crossing", however, the comparator 29 does not identify the zero crossing of the differentiated current waveform. The comparator only identifies the zero crossing of the differentiated current $T_2$ when the potentiometer is set so that the voltages on lines 39 and 41 are the same as stated on page 6, lines 19–21 of the present specification. Under these conditions, there is no current flow in the resistors 30 and 32 which are directly connected to terminal 4 and terminals 4 and 5 are biased to the same voltage level, otherwise, the comparator actually identifies $T_1$. A purpose of FIG. 4 is to illustrate this distinction. Voltage is always measured relative to some reference and the comparator 29 is controlled by the voltage difference between the two inputs 4 and 5. If the terminal 4 of the comparator is taken as the reference, the comparator always responds to a "zero crossing". An increase in the setting of potentiometer 27 effectively raises the zero voltage line in FIG. 4 upwardly to a positive value as, for example, to line 45 thereby also indicting an earlier crossing of the line 45 at T1. The difference between T1 and T2 is preferably on the order of 30 microseconds.

Comparator 29, which may be a type LM 319 with the pin number connections shown within the triangle, functions to compare the voltages on lines 31 and 33, and to provide an output signal in the form of a change in the output voltage level (waveform C) on line 36 upon the occurrence of each zero crossing, that is, when the two input voltages on lines 31 and 33 are the same. The 12 volt solenoid power supply on line 43 is utilized to operate the comparator 29 and a 5 volt low impedance reference on line 64 with respect to the 12 volt return on line 45 is provided by a 5 volt regulator 62 such as a LM78L05. With line 45 at zero volts, line 64 is +5 volts and line 43 is +12 volts. A 4N33 photo coupler 47 provides electrical isolation between the high current transitions of the solenoid drivers (pins 1 and 2) and the logic circuitry connected to pins 4 and 5 thereof.

At the start of each sampling period, the pulse width necessary for delivery to the proper solenoid is calculated by control computer 59 from a linear relationship (request minus position at each sampling time) and that solenoid is turned on by the solenoid driver circuit 53 enabling the corresponding switching device 49 or 51. The enable flipflop 55, for example, a type 74LS109, is held in a reset state by applying an inverted carry signal (waveform B) to its reset input pin. The pulse width counter 578 dwells in the carry state until new pulse width data is loaded by the control computer 59 from the initial count block 60 into the counter 57 at which time the reset signal is removed from the flipflop 55. The next zero crossing level change on line 36 sets the flipflop (signal C') to its high state and an output (waveform D) enables the counter 57 to count up from the preloaded count 60 and when the counter reaches the carry state, solenoid driver 53 disables the corresponding switching device. These switching devices 49 and 51 may be bistable PNPN devices such as trigistor units which respond to both turn-on and shut-off gate signals throughout their operating range, or conventional power transistors may be employed. Also, a suitable solenoid drive circuit is shown in FIG. 6 of U.S. Pat. No. 4,656,989.

In summary then, a pulse width control circuit as shown in FIG. 1 energizes a solenoid such as shown in FIG. 5 of the type having a moveable armature 34 which is reciprocable along an axis between open and closed Positions for the valve 68. A coil spring 66 or other biasing means urges the armature 34 toward the valve-closed position and an actuating coil 35 is responsive to current flow for inducing a force on the armature 34 to overcome the spring force and move the armature from the valve-closed position toward the valve-open position. The pulse width control circuit is seen to include a means for initiating current flow in the actuating coil (either 35 or 37) including the solenoid drivers 53 and corresponding switch (either 49 or 51). Current flow to the actuating coil is sensed by the voltage drop across resistor 21. A resistance-capacitance circuit 23, 25 differentiates the sensed current flow to the actuating coil. A comparator 29 identifies the time at which the differentiated current is at a prescribed value. A variable direct current biasing circuit including potentiometer 27 is coupled to the comparator for setting the prescribed value to provide an estimate of the departure time of the armature from the first or valve-closed position. A counter 57 is responsive to a train of timing pulses from clock 61 which is coupled to the counter. An initial count 60 indicative of a predetermined time is loaded into the counter. The comparator output initiates timed counter operation at the estimated departure time to modify the initial count from 60 as a function of time. The means for initiating current flow is operable upon the count in said counter 57 reaching a predetermined final count (typically when a carry occurs) to terminate current flow to the actuating coil a predetermined time after initial armature movement away from the first position. The counter responsive circuit means may be connected to a plurality of solenoids such as 35 and 37. The counter responsive circuit means and the means for initiation current flow share at least one common circuit element, namely, the switch (either 49 or 51).

From the forgoing, it is now apparent that novel solenoid actuating and actuation detecting arrangements have been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A pulse width control circuit for energizing a solenoid having a moveable armature reciprocable along an axis between first and second positions, biasing means for urging the armature toward the first position and an actuating coil responsive to current flow for inducing a force on the armature to overcome the biasing means to move the armature from the first position toward the second position, the pulse width control circuit comprising;

means for initiating current flow in the actuating coil;

means for sensing current flow to the actuating coil;

a resistance-capacitance circuit for differentiating sensed current flow to the actuating coil;

comparator means coupled to said resistance-capacitance circuit for identifying the time at which the differentiated current is at a prescribed value;

a variable direct current biasing circuit coupled to an input of said comparator means for setting the prescribed value to provide an estimate of the departure time of the armature from the first position;

a counter;

a source of timing pulses coupled to said counter;

means for loading an initial count indicative of a predetermined time into said counter; and means responsive to said comparator mean for initiating timed counter operation at the estimated departure time to modify the initial count as a function of time, said means for initiating current flow being operable upon the count in said counter reaching a predetermined final count to terminate current flow to the actuating coil a predetermined time after initial armature movement away from the first position.

2. The pulse width control circuit of claim 1 wherein said means for initiating current flow being connected to a plurality of solenoids.

* * * * *